US007858052B2

(12) United States Patent
Ament

(10) Patent No.: US 7,858,052 B2
(45) Date of Patent: Dec. 28, 2010

(54) CATALYTIC CONVERTER OPTIMIZATION

(75) Inventor: Frank Ament, Troy, MI (US)

(73) Assignee: GM Global Technology Operations, Inc.

( * ) Notice: Subject to any disclaimer, the term of this patent is extended or adjusted under 35 U.S.C. 154(b) by 1010 days.

(21) Appl. No.: 11/625,987

(22) Filed: Jan. 23, 2007

(65) Prior Publication Data

US 2008/0175762 A1 Jul. 24, 2008

(51) Int. Cl.
*B01D 50/00* (2006.01)

(52) U.S. Cl. ..... 422/180

(58) Field of Classification Search ..... 422/177, 422/180

See application file for complete search history.

(56) References Cited

U.S. PATENT DOCUMENTS 6,475,453 B1 11/2002 Mathes et al.

FOREIGN PATENT DOCUMENTS

JP 10141047 A * 5/1998

* cited by examiner

*Primary Examiner*—Tom Duong

(57) ABSTRACT

A catalytic converter includes an inlet. A first sub-section of substrate is located a first distance from the inlet that includes a first catalyst coating having a first density. A second sub-section of substrate is located a second distance from the inlet that includes a second catalyst coating having a second density. The second distance is greater than the first distance and the second density is greater than the first density.

11 Claims, 5 Drawing Sheets

CATALYTIC CONVERTER OPTIMIZATION

FIELD

The present disclosure relates to catalytic converters.

BACKGROUND

The statements in this section merely provide background information related to the present disclosure and may not constitute prior art.

Automobile engines produce emissions such as carbon monoxide (CO), volatile organic compounds (VOCs), and nitrogen oxides (NOx). An automobile may include one or more catalytic converters that are designed to reduce these emissions. A catalytic converter includes a plurality of substrates coated with catalysts, such as precious group metals like platinum, rhodium and/or palladium. The structure is designed to expose a maximum surface area of the catalysts to exhaust flowing from the engine thus, reducing a level of emissions in the exhaust through chemical reactions with the catalysts.

Conventional catalytic converters provide a higher density of catalysts in a forward section of the catalytic converter to increase the reduction of emissions. At the same time, conventional converters provide a lower density of catalysts in a distal section of the catalytic converter to decrease cost. More particularly, with reference to FIG. 1, a catalytic converter 10 according to the prior art is shown. The catalytic converter 10 includes an inlet 12 that allows exhaust 14 to enter the catalytic converter 10 and an outlet 16 that allows exhaust 14 to exit the catalytic converter 10.

The catalytic converter 10 includes a first substrate 18 arranged in a first sub-section 20 of the catalytic converter 10 and a second substrate 22 arranged in a second sub-section 24 of the catalytic converter 10. The first substrate 18 includes a first catalyst coating 26. The catalyst coating 26 is evenly distributed at a first density throughout the first substrate 18. The coating 26 generally includes oxidation catalysts such as platinum and palladium. The second substrate 22 includes a second catalyst coating 28. The second catalyst coating 28 is evenly distributed throughout the second substrate 22 at a second density that is less than the first density. The second coating 28 generally includes oxidation and reduction catalysts such as platinum, palladium and rhodium.

This design is a viable trade-off for catalytic converters with lower exhaust temperatures and more lenient emissions standards. With the advent of catalytic converters mounted closer to the engine, resulting in higher exhaust temperatures and faster catalyst warm-up rates, the higher density of catalysts on the front section adds minimal reduction in emissions. Stricter emissions standards generate a need for a greater reduction in emissions without a large increase in the amount of Precious Metals added to the catalysts.

SUMMARY

In view of the above, the present disclosure teaches a catalytic converter. The catalytic converter includes an inlet. A first sub-section of substrate is located a first distance from the inlet that includes a first catalyst coating having a first density. A second sub-section of substrate is located a second distance from the inlet that includes a second catalyst coating having a second density. The second distance is greater than the first distance and the second density is greater than the first density.

In other features, a method of forming a catalytic converter is provided. The method includes: dividing at least one substrate structure into a plurality of sub-sections; coating a first sub-section of the plurality of sub-sections with a first density of catalysts; coating a second sub-section of the plurality of sub-sections with a second density of catalysts greater than the first density; providing the first sub-section within a first distance from an inlet of the catalytic converter; and providing the second sub-section within a second distance greater than the first distance from the inlet.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
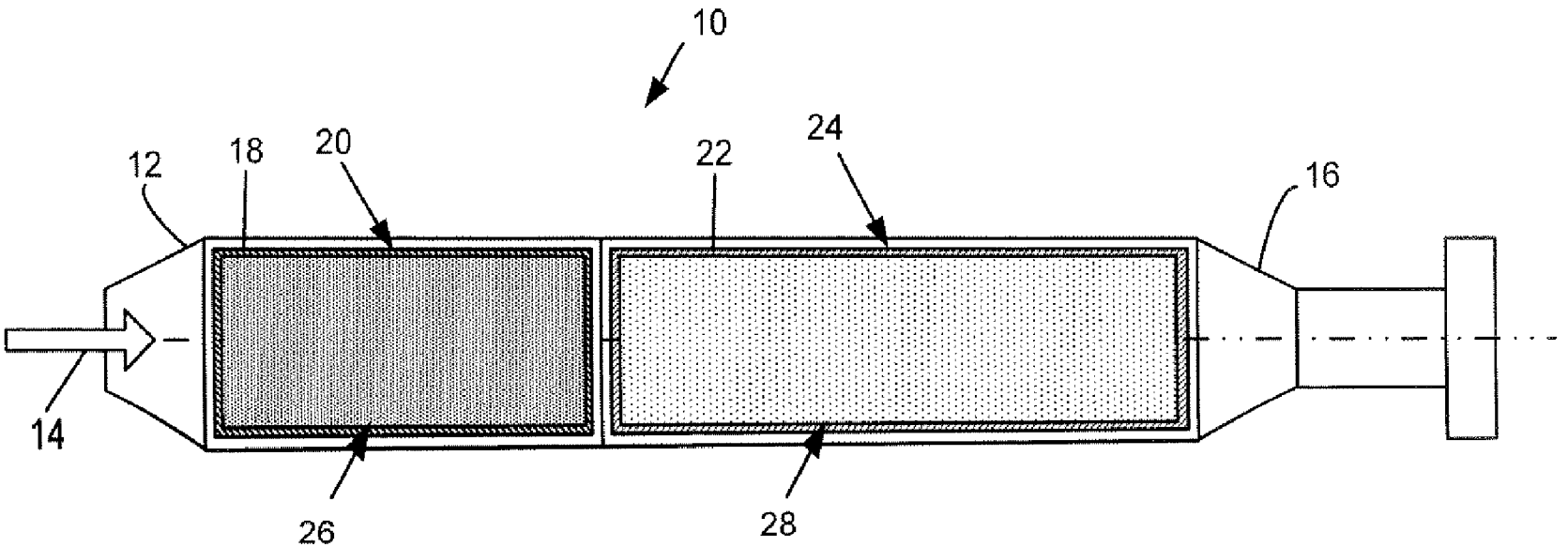
FIG. 1 PRIOR ART
FIG. 1 is a cross-sectional view of a catalytic converter according to the prior art.

The following description is merely exemplary in nature and is not intended to limit the present disclosure, application, or uses. It should be understood that throughout the drawings, corresponding reference numerals indicate like or corresponding parts and features.

Figure 2:
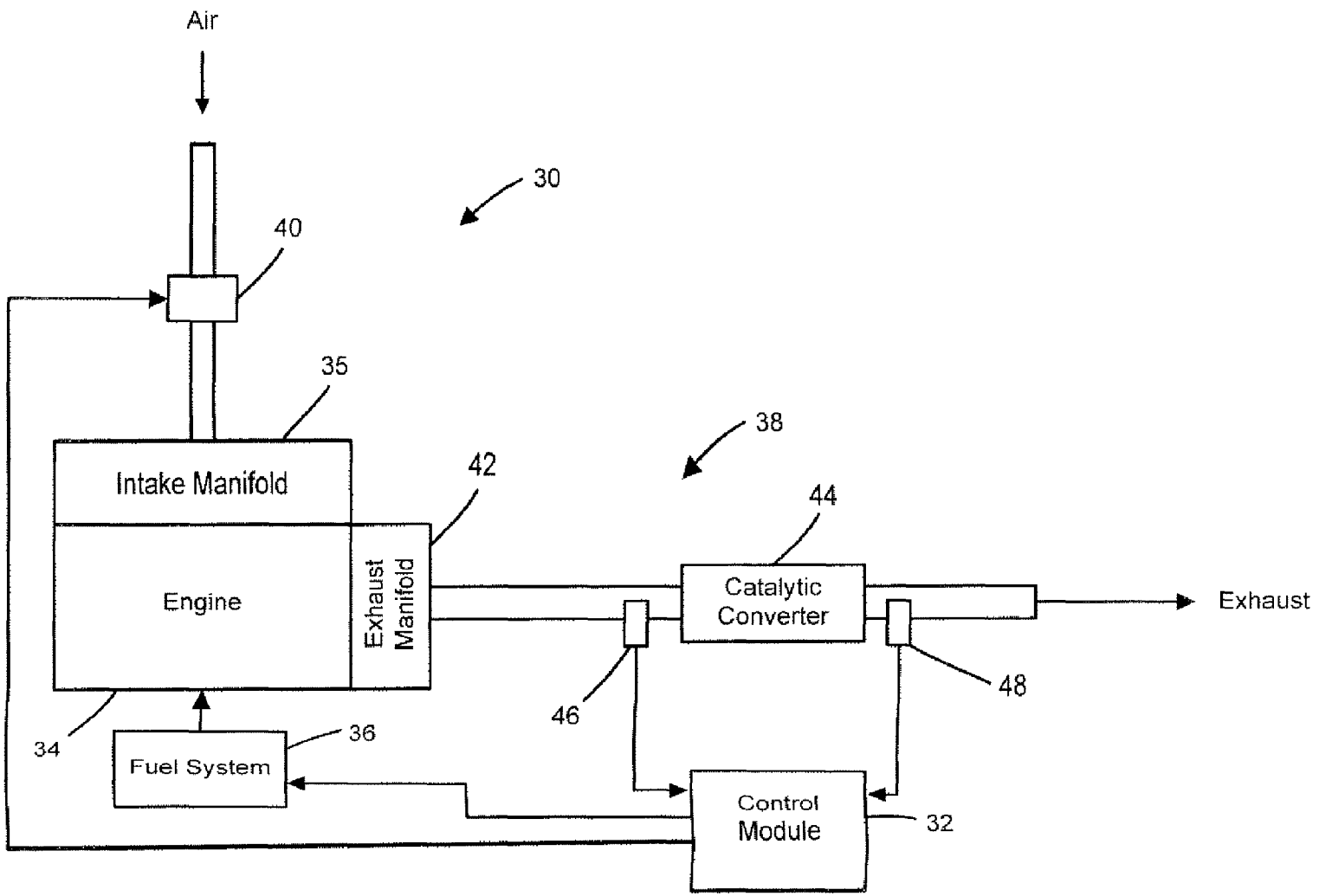
FIG. 2 is a block diagram illustrating an engine control system.

Referring now to FIG. 2, a vehicle 30 includes a control module 32, an engine 34, a fuel system 36, and an exhaust system 38. A throttle 40 communicates with the control module 32 to control air flow into an intake manifold 35 of the engine 34. The amount of torque produced by the engine 34 is proportional to mass air flow (MAF) into the engine 34. The engine 34 operates in a lean condition (i.e. reduced fuel) when the A/F ratio is higher than a stoichiometric A/F ratio. The engine 34 operates in a rich condition when the A/F ratio is less than the stoichiometric A/F ratio. Internal combustion within the engine 34 produces exhaust gas that flows from the engine 34 to the exhaust system 38, which treats the exhaust gas and releases the exhaust gas to the atmosphere. The control module 32 communicates with the fuel system 36 to control the fuel supply to the engine 34.

The exhaust system 38 includes an exhaust manifold 42, a catalytic converter 44, and one or more oxygen sensors 46, 48. The catalytic converter 44 controls emissions by increasing the rate of oxidation of hydrocarbons (HC) and carbon monoxide (CO) and the rate of reduction of nitrogen oxides ($NO_x$). The catalytic converter 44 requires oxygen. The oxygen sensor 46, measures the amount of oxygen entering the catalyst, and oxygen sensor 48 provides feedback to the control module 32 indicating a level of oxygen in the exhaust. Based on the oxygen sensor signals, the control module 32 controls air and fuel at a desired air-to-air (A/F) ratio to provide optimum engine performance as well as to provide optimum catalytic converter performance.

Figure 3:
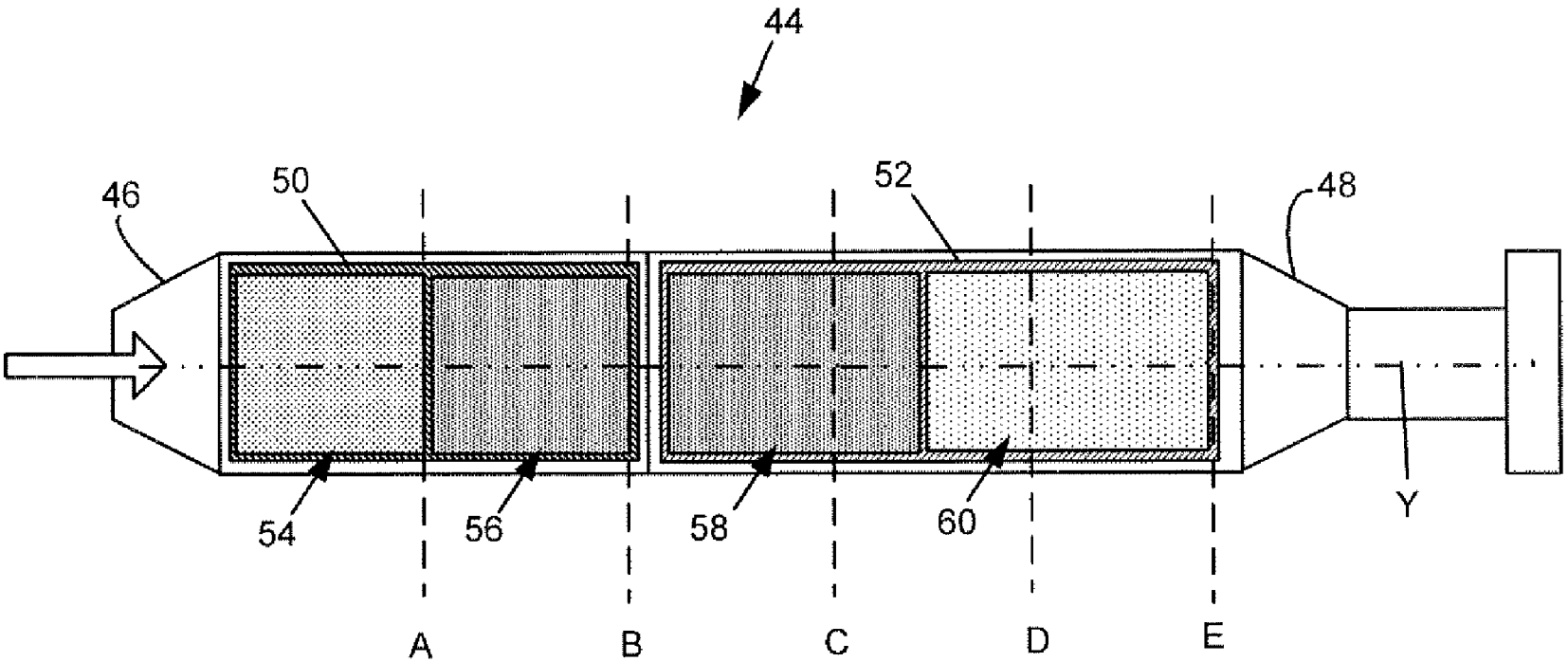
FIG. 3 is a cross-sectional view of a catalytic converter according to the present teachings.

Referring now to FIG. 3, an exemplary catalytic converter 44 according to various embodiments is shown. According to the present disclosure, catalyst coatings within the catalytic converter are distributed in sub-sections at varying densities optimized by catalyst temperature and catalyst activation temperature. In other words, densities of the catalyst coatings are varied according to an operating temperature of the catalytic converter to optimize efficiency. For example, since the improvement in catalyst conversion efficiency diminishes for temperatures far above the activation temperature, the density of the first coating is reduced where the temperature of the catalytic converter is much greater than a catalyst activation temperature. Conversely, the density of the second coating is increased where the temperature of the catalytic converter is lower. As can be appreciated, varying the density of the catalyst coatings according to the present disclosure can be applied to catalytic converters including one or more substrate structures. As also can be appreciated, the densities of the catalyst coatings can be applied in a step-like format or a continuous or linear format.

As shown in FIG. 3, an exemplary catalytic converter 44 includes an inlet 46 that allows the exhaust to enter the catalytic converter 44 and an outlet 48 that allows the exhaust to exit the catalytic converter 44. The catalytic converter 44 further includes at least two substrate structures 50, 52. The substrate structures 50, 52 may include a ceramic structure formed in one of a honeycomb structure, a bead structure, or the like. The physical properties of the two substrate structures may also vary depending on the intended functions. The first substrate structure 50 further includes a first sub-section 54 and a second sub-section 56. The first sub-section 54 is located a first distance from the inlet 46. The second sub-section 56 is located a second distance from the inlet 46 that is greater than the first distance. The first sub-section 54 within the first substrate structure 50 is coated with catalysts at a first density. The first coating can include an oxidation catalyst that reduces Hydrocarbon and Carbon Monoxide emissions. The oxidation catalyst includes, but is not limited to, palladium, platinum, and/or the like. The second sub-section 56 within the first substrate structure 50 is coated with catalysts at a second density. The second density is greater than the first density. The second coating can include an oxidation catalyst that reduces Hydrocarbon and Carbon Monoxide emissions, as discussed above, and it may also include a NOx reduction catalyst, such as rhodium.

The second substrate structure 52 further includes a first sub-section 58 and a second sub-section 60. The first sub-section 58 is located a third distance from the inlet 46. The third distance is greater than the second distance. The second sub-section 60 is located a fourth distance from the inlet 46. The fourth distance is greater than the third distance. The first sub-section 58 of the second substrate structure 52 includes a third coating of catalysts coated according to a third density that is less than or equal to the second density. The third coating can include both oxidation and reduction catalysts that simultaneously reduce CO, Hydrocarbon and NOx emissions. The catalysts include, but are not limited to, platinum, palladium, rhodium and/or the like. The second sub-section 60 of the second substrate structure 52 includes a fourth coating of catalysts coated according to a fourth density that is less than the first, second, and third densities.

Figure 4:
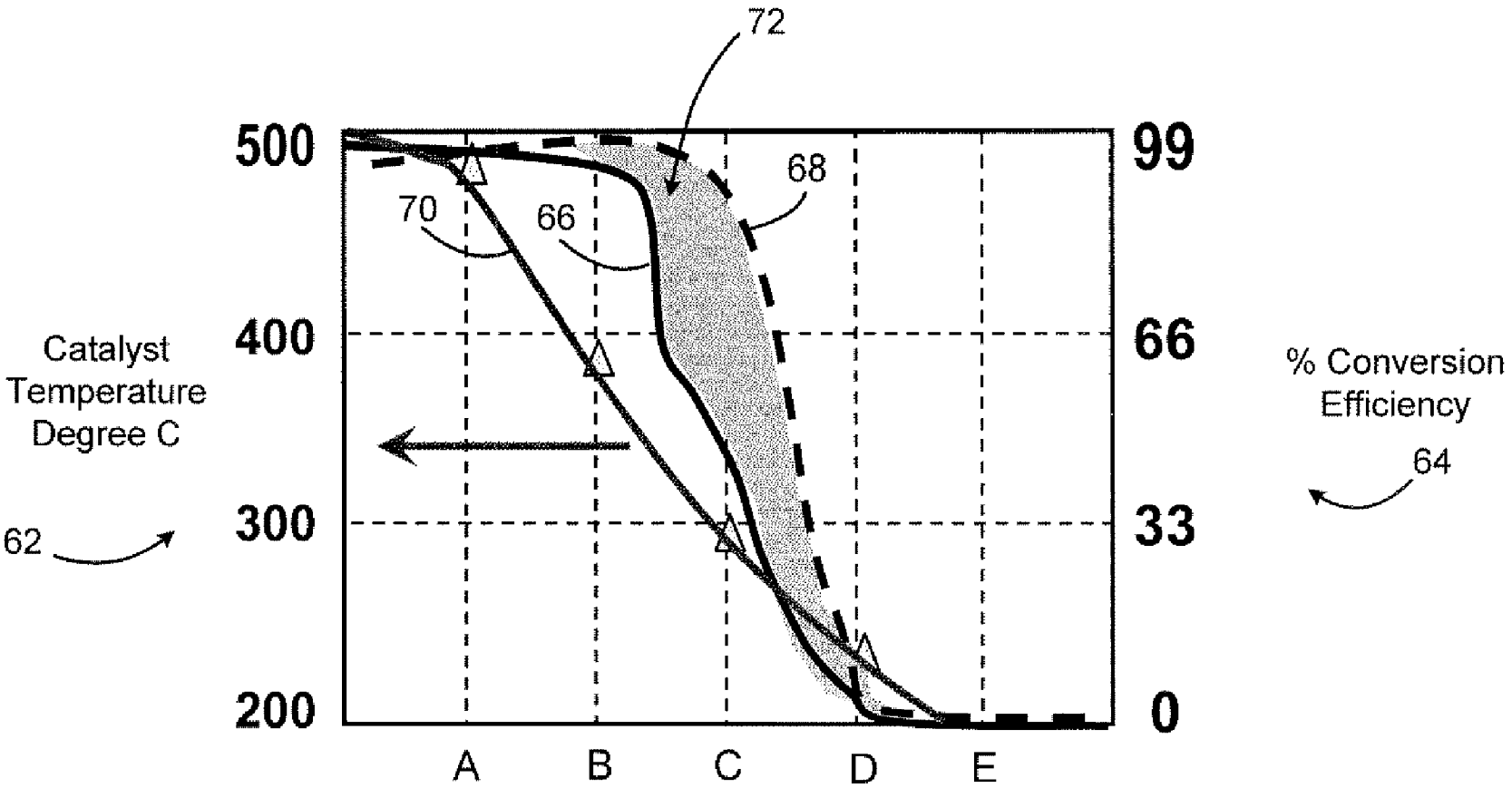
FIG. 4 illustrates catalyst temperature and active catalyst volume during a first acceleration cycle.

With continued reference to FIG. 3 and referring now to FIG. 4, a graph illustrates catalyst temperature and conversion efficiency data during a first acceleration cycle. Catalyst temperature is shown along the left y-axis at 62. Conversion efficiency is shown along the right y-axis at 64. Catalyst conversion efficiency data at points A, B, C, D, and E along the center axis (Y) of the catalytic converter 10 according to the prior art is shown at 66. Catalyst conversion efficiency data at substantially similar points A, B, C, D and E along the center axis (Y) of the catalytic converter 44 of FIG. 3 is shown at 68. The catalyst temperature data is shown at 70. The increased densities in sub-sections between points B and D provide for a greater conversion efficiency at the same catalyst temperature as shown at 72. Increasing the density of catalysts in sub-sections based on the catalyst temperature decreases the catalyst light-off or activation temperature.

Figure 5:
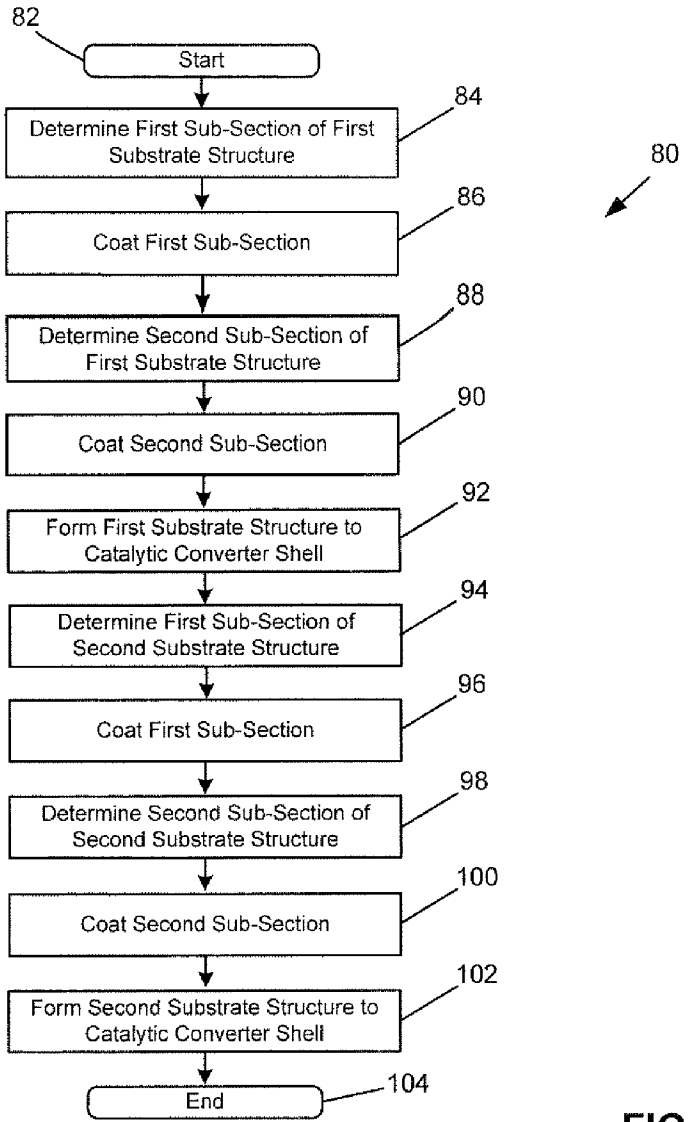
FIG. 5 is a flowchart illustrating a method of forming a catalytic converter according to the present teachings.

To further illustrate a catalytic converter of the present disclosure, an exemplary method for coating substrate structures to be formed within a catalytic converter is shown in FIG. 5. As can be appreciated, steps of the method can be performed in varying order. Therefore, the present disclosure is not limited to the sequential execution as shown in FIG. 5. The exemplary method is generally shown at 80. The exemplary method may begin at 82. A first sub-section of the substrate structure is determined at 84. The area of the first sub-section can be determined based on at least one of catalyst temperature and catalyst activation temperature. The first sub-section of the substrate structure is coated with a first catalyst coating according to a first density at 86. A second sub-section of the substrate structure is determined at 88. The area of the second sub-section can be determined based on at least one of catalyst temperature and catalyst activation temperature. The second sub-section of the substrate structure is coated with a second coating according to a second density that is greater than the first density at 90. The substrate structure is formed at a first distance from an inlet of the catalytic converter at 92.

A first sub-section of a second substrate structure is determined at 94. The area of the first sub-section can be determined based on at least one of catalyst temperature and catalyst activation temperature. The first sub-section of the second substrate structure is coated with a third catalyst coating according to a third density at 96. A second sub-section of the second substrate structure is determined at 98. The area of the second sub-section can be determined based on at least one of catalyst temperature and catalyst activation temperature. The area of the second sub-section can be less than the area of the first sub-section. The second sub-section of the second substrate structure is coated with a fourth catalyst coating according to a fourth density at 100. The fourth density is less than the third density. The second substrate structure is formed a second distance from the inlet of the catalytic converter at 102. The second distance is greater than the first distance. The method ends at 104.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. A catalytic converter, comprising:

an inlet;

a first sub-section of substrate located a first distance from the inlet that includes a first catalyst coating having a first density;

a second sub-section of substrate located a second distance from the inlet that includes a second catalyst coating having a second density wherein the second distance is greater than the first distance and the second density is greater than the first density; and a third sub-section of substrate located a third distance from the inlet that includes a third catalyst coating having a third density, wherein the third distance is greater than the second distance, and wherein the third density is greater than the first density and less than the second density.

2. The catalytic converter of claim 1 further comprising a fourth sub-section of substrate located a fourth distance from the inlet that includes a fourth catalyst coating having a fourth density.

3. The catalytic converter of claim 2 wherein the fourth distance is greater than the third distance and the fourth density is less than the third density.

4. The catalytic converter of claim 2 wherein the fourth density is less than the first density.

5. The catalytic converter of claim 2 wherein the first density, the second density, the third density, and the fourth density provide a linear change in density.

6. The catalytic converter of claim 2 wherein the first density, the second density, the third density, and the fourth density provide a step-like change in density.

7. The catalytic converter of claim 1 wherein the first catalyst coating includes at least one of oxidation catalysts and oxidation and reduction catalysts.

8. The catalytic converter of claim 1 wherein at least one of the second catalyst coating and the third catalyst coating includes oxidation and reduction catalysts.

9. The catalytic converter of claim 2, wherein the first, second, third, and fourth catalyst coatings consist of platinum group metals (PGM).

10. The catalytic converter of claim 2, wherein the first, second, third, and fourth catalyst coatings include rhodium.

11. The catalytic converter of claim 2, wherein a boundary between the second and third sub-sections of substrate corresponds to a temperature at which the catalytic converter is fifty percent efficient.

* * * * *